United States Patent [19]

Black

[11] Patent Number: 4,702,429

[45] Date of Patent: Oct. 27, 1987

[54] EXPANDABLE REEL ASSEMBLY

[75] Inventor: Allen C. Black, Winston-Salem, N.C.

[73] Assignee: AMP Incorporated, Harrisburg, Pa.

[21] Appl. No.: 884,324

[22] Filed: Jul. 10, 1986

[51] Int. Cl.[4] ..... B65H 75/14; A41F 1/04

[52] U.S. Cl. ..... 242/71.8; 242/71.9; 242/116; 242/118.5; 24/575; 24/630

[58] Field of Search ..... 242/71.8, 71.9, 77, 242/115, 116, 118.4, 118.5, 118.6, 118.61; 24/575, 578, 605, 630; 403/408.1

[56] References Cited

U.S. PATENT DOCUMENTS

| | | | |
|---|---|---|---|
| 3,822,841 | 7/1944 | Campbell | 242/115 |
| 3,861,614 | 1/1975 | Horak | 242/116 X |
| 4,068,808 | 1/1978 | King | 242/118.4 |
| 4,101,095 | 7/1978 | Carter | 242/115 |
| 4,193,560 | 3/1980 | Diegel | 242/71.9 |
| 4,428,546 | 1/1984 | Weideman | 242/118.5 |
| 4,515,322 | 5/1985 | Shiba et al. | 242/71.8 |
| 4,515,323 | 5/1985 | Rood et al. | 242/71.8 X |

*Primary Examiner*—Stuart S. Levy
*Assistant Examiner*—David Werner
*Attorney, Agent, or Firm*—Eric J. Groen

[57] ABSTRACT

A reel assembly includes two flanges with an expanded polystyrene core therebetween. Two fastener members inserted from opposite sides of the flanges project through the flanges and core and lock with each other. The fasteners are hermaphroditic in nature, each fastener member having a male and a female latching member. When the latching members are inserted into the flanges diametrically opposed position with respect to each other, the respective male and female latching members lock between themselves the flanges and the core.

11 Claims, 3 Drawing Figures

EXPANDABLE REEL ASSEMBLY

BACKGROUND OF THE INVENTION

1. Field of the Invention

The present invention relates to an expandable reel assembly which can accommodate a family of reel sizes.

2. Description of the Prior Art

In the electronics industry, and especially respecting electrical connectors, great care is taken to insure careful handling of the fragile components. This care in handling continues into the shipping process where much time, effort and money is invested to ensure that electrical connectors or their components arrive at their destination undamaged.

When electrical terminals are stamped and formed, they are stamped and formed from narrow rolls of strip stock, each terminal remaining on the carrier strip and then rerolled onto a reel for shipping purposes. The reel of terminals could then be shipped on the reel to a customer or to an assembly plant where the terminals would be installed in connector housings.

In either event, there are certain requirements for the design of the reels. First, the reels must be produced without great expense. As the reels are not typically reusable or returned from the customer, the reels must be an inexpensive component of the cost of the connectors. Second, the reels must be modular in nature, as it is not desirable to have a large quantity of reels previously assembled, as the reels become damaged or the flanges warped; furthermore, the storage space required to store the previously assembled reels is large compared to the space required to store the component parts. Third, the components of reels must be interchangeable to offer a family of reel sizes as several reel sizes are required. Fourth, the reels must be durable as most times the reels are shipped by truck and, therefore, subject to constant shock and vibration. Fifth, the reels must be capable of being installed on an automated assembly machine having an arbor with a drive mechanism, as the components shipped on the reels, whether terminals or complete connectors, are typically mass inserted by an assembly machine into the next respective assembly. Sixth, the assembly of the modular components must be done quickly and easily without complicated tools, or without gluing or otherwise handling the components together, as these processes are time consuming for a shipping department to achieve.

There is disclosed in U.S. Pat. No. 4,101,095 a reel capable of assembling and disassembling with a wide variation of widths. However, the rotatable locking mechanism shown best in FIG. 2 is a precision fit match between the pair of hub members 24, 16, resulting in a high cost assembly which is not desirable for shipping purposes. The design in the U.S. Pat. No. 4,101,095 also requires two components for the hub assembly requiring an increased burden for inventory control within a shipping department. It has also been found that the design in the U.S. Pat. No. 4,101,095 is not feasible for use on an automated assembling machine having an arbor. As the assembly machine drive mechanism requires frequent and sudden torque at its spindle, it was found that the hub assembly would actually unlock causing the rolled components to become dislodged from the reel.

Another type reel is disclosed in U.S. Pat. No. 3,822,841 and includes a hub member 12 having latch members 24 which lock over the flange members 14. A disadvantage to this type design is that the typical vibration involved in shipping causes the flange members to become disassembled from the hub member thereby damaging the components on the reel.

Another reel of the prior art, although not patented, includes two cardboard flanges having a cardboard spacer glued therebetween. The cardboard spacer includes a cardboard tube with corrugated paper wrapped therearound and glued to the spool. The disadvantage to this spool design is a result of the process of its manufacture.

The spacers were manufactured in long rolls then cut to various widths as required for the application. The spacers could not always be cut squarely, nor could the spacers be centered with the center of the flange causing unusuable reels. Furthermore, the reels must be purchased in an assembled fashion requiring an unnecessary amount of storage space within a shipping department.

SUMMARY OF THE INVENTION

It is an object of the invention to design an inexpensive reel for shipping electrical components.

It is an object of the invention to design a reel which can be assembled within a shipping department without costly processes.

It is an object of the invention to design a reel which utilizes few component parts alleviating. the storage space required for a plurality of components.

It is an object of the invention to design components to be expandable in order to accommodate several different size components to be shipped.

It is an object of the instant invention to design a reel assembly which will not be destroyed when subject to vibration incurred during shipment.

The invention includes a circular core member with sidewalls and a circumferential surface therearound, and a central passageway therethrough. Two flanges of a larger diameter than the core members are positioned against opposite sidewalls of the core member, and have at least two through holes aligned with the passageway. Two hermaphroditic fastener members are positioned against the flanges and have locking means extendable into the through holes for locking the flanges and core together.

The flanges are made of corrugated cardboard, the core member consists of expanded polystyrene and the fastener members are made of plastic, all components being inexpensive to manufacture. All components are easily assembled within a shipping department without assembly equipment, and without having to glue any of the components together. The fastener members are hermaphroditic in nature thereby alleviating having to stock more than one part number for the fastener within a shipping department's inventory. The fastener members include incremental annular threads allowing several different widths of expanded polystyrene cores to be used. The fastener members were designed to require approximately 140 pounds of pull apart force, assuring that the fastener members will stay in tact during shipment.

DETAILED DESCRIPTION OF THE PREFERRED EMBODIMENT

Figure 1:
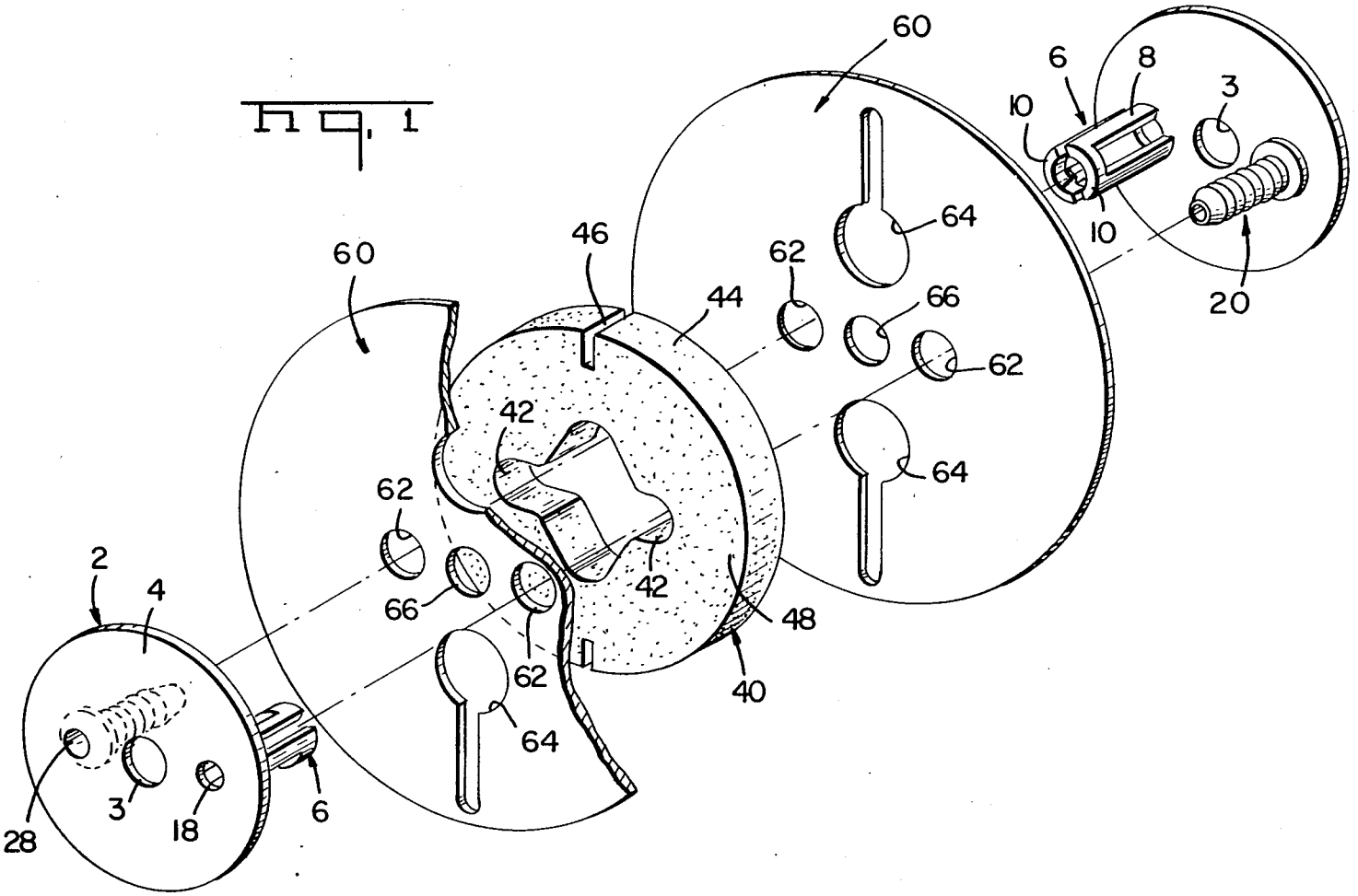
FIG. 1 is a perspective view of the components of the instant invention shown in an exploded fashion.

Referring to FIG. 1, there is shown a perspective view of the preferred embodiment of the instant invention including two identical fastener members 2, two flange members 60, and a core member 40. The fasteners 2 include a disc portion 4, and male 20 and female 6 fastener portions extending from one side of the disc.

Figure 2:
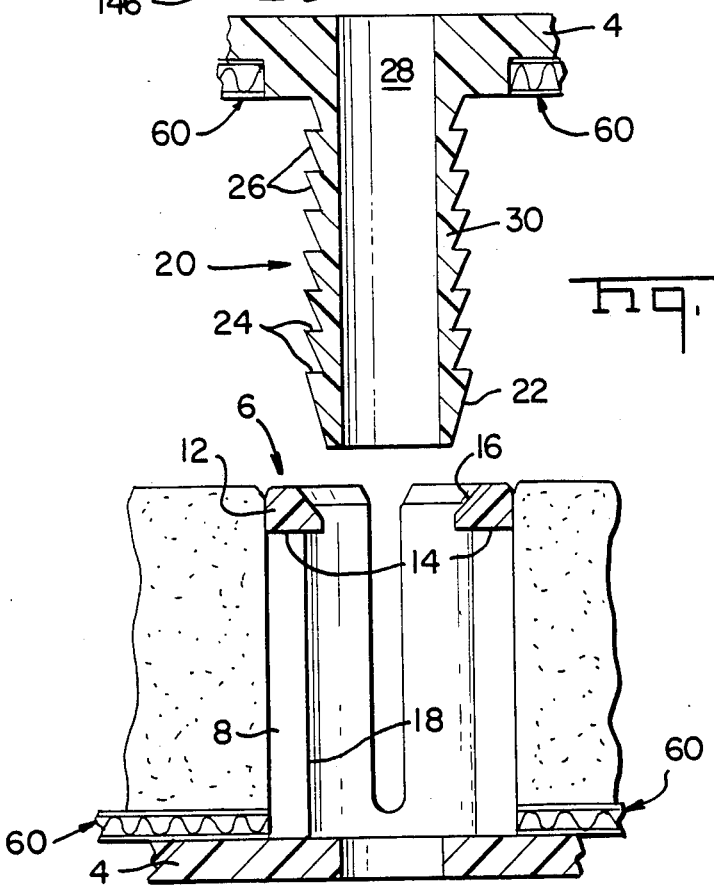
FIG. 2 is a cross-sectional view of the fastener locking arrangement.

The female fastener portion includes four beam portions 8 extending from the disc portion 4, with two of the beam portions interconnected by semicircular band portions 10. As best shown in FIG. 2, the female fastener portion 6 also includes two latch members 12 integral with the band portions 10. The latch member 12 includes a develed surface 16 and a locking surface 14.

The male fastener portion includes a post member 30 extending from the disc 4 having annular threads 26 and locking surfaces 24 thereon. The first annular thread has a long camming surface 22 for initially opening the latch members 12.

Figure 3:
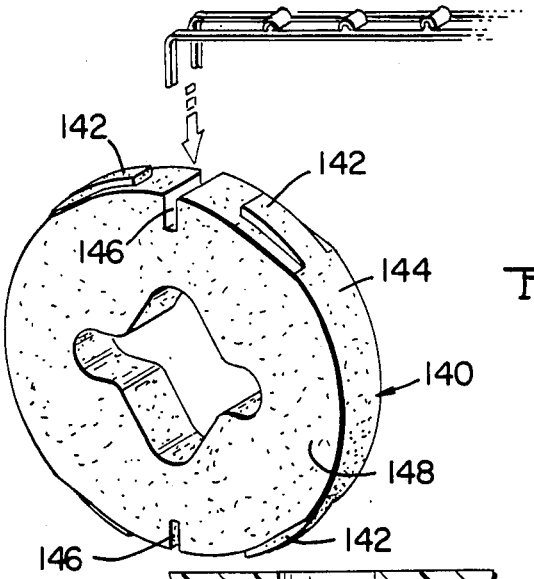
FIG. 3 is a perspective view of an alternate embodiment core.

Referring again to FIG. 1, the core member 40 is preferably made of a light inexpensive composition such as expanded polystyrene. The core 40 includes two sidewalls 48 and a peripheral surface 44 having a starting slot 46 therein. The core 140 of an alternate embodiment could include a starting notch 146 and a latch member 142 as shown in FIG. 3. The core 40 further includes fastener through holes 42.

The preferred embodiment of the invention further includes two flanges 60, preferably of an inexpensive material such as corrugated cardboard. The flange member includes entry holes 64, drive holes 66 and fastener through holes 62.

A reel is assembled by sandwiching a core member 40 between two flanges 60, aligning the flange through holes with the core through holes 42. The fasteners 2 may then be inserted into the flange through holes 62, such that the male fastener portions 20 intersect with the female portions 6 locking the assembly together. It should be apparent that the fastener member is hermaphroditic in nature which alleviates making and storing several component parts.

In the shipping of component parts on reels, several widths of reel cores are required as several widths of components are shipped. Typically, the distance between the inside surfaces of the flanges 60 on an assembled reel is approximately $\frac{1}{8}''$ larger than the width of the material being shipped on the reel. Conveniently then, the instant invention incorporates a plurality of annular threads in increments of $\frac{1}{8}''$ allowing distances between flanges of $\frac{7}{8}''$ to $1\frac{5}{8}''$. It should be understood that any size fastener is possible with any number of annular threads having any size increment between successive threads.

To ensure a solid assembly, the core member 40 is designed to allow a slight amount of crush prior to the surfaces 24 of the annular threads locking behind surfaces 14 of the female portion 6.

Typically, electrical parts to be shipped are fastened to a strip of tape such as Mylar and adhesively held thereto. The tape end may then be inserted in the slot 46 of the core 40. To ensure that the strip remains in place when reeling the parts, an entry 64 is provided which allows an operator to place his or her finger through the entry and onto the tape end during the first few wraps. If terminals are being shipped, the terminal ends may be inserted into the slot 146 of the alternate core 140, as shown in FIG. 3, and a terminal may be positioned to lock itself and the strip of terminals on the latch member 142.

The preferred embodiment of the instant invention includes a plurality of core diameters. When electrical terminals are shipped on reels, depending on the stiffness of the material, many times the unwrapped configuration of the terminals contains a partially coiled configuration. Thus the cores may be stocked in various diameters and selected for varying shipping applications.

When a reel of shipped components reaches the shipping destination, usually the components are unwrapped via an automatic assembly machine. This machine typically has a drive spindle mounted on an arbor, the drive spindle having two posts for rotating the reels, one on center and one off center. The instant invention was designed to match the drive configuration of the spindle drive posts. The assembled reel loaded with components may be placed on the drive spindle with the centered post through drive hole 3 of the fasteners, and through holes 66 of the flanges. The off center post of the drive spindle may be placed through either through hole 18 or 28 of the fastener 2.

The present invention inexpensively removes the shortcomings of the prior art designs. The fastener members are hermaphroditic in nature requiring only one fastener part number to be stocked within the shipping department. The flanges, cores and fastener members are all modular in nature allowing assembly only when required, thereby minimizing the required storage space. The instant invention allows for any easy assembly for a shipping department employee without having to use glues or acetone. The instant invention also provides for an assembly that will not disassemble upon vibration incumbent upon shipping, as the instant invention requires approximately 140 pounds force to unlock the mated fastener members. The instant invention is also modular in nature allowing interchangeability between different diameter cores, different widths of cores and different diameters of flanges, all using one size of fastener member.

What is claimed:

1. A reel assembly comprising:

a circular core member having sidewalls, a circumferential surface, and a central passageway therethrough;

two flange members having a larger diameter than said core member, each flange member being positioned against a sidewall of said core member, and having at least two through holes aligned with said passageway; and two like fastener members, each fastener member including a disc having a male and female fastener member extending from the disc, the male and female members being equally spaced from and on a line through the center of the disc, each fastener member being positioned against different of said flange members, and each having locking means associated with the male and female members, extendable into said through holes and passageway, for locking said flanges and core together.

2. The assembly of claim 1 wherein the male fastener member comprises a post having annular threads extending therearound.

3. The assembly of claim 2 wherein the female fastener member comprises means for receiving a complementary male fastener member and a latching member engageable with the annular threads of said complementary male fastener member.

4. The connector of claim 3 wherein the female fastener member comprises two pairs of beam members extending from said disc, each pair of beams interconnected by a band portion having an integral latch.

5. The connector of claim 1 wherein the core member is composed of expanded polystyrene.

6. The connector of claim 1 wherein the core member comprises means for starting components to be wrapped on the core.

7. The connector of claim 4 wherein the annular threads are spaced at incremental positions to accommodate several different core widths.

8. The connector of claim 7 wherein the threads are spaced to provide a slight interference fit between the flanges and core.

9. A hermaphroditic fastener member for retaining two flanges against a central core member, the flanges and central core having through holes at equal radial distances from centers of the flanges and core on a line through said centers, the fastener member comprising male and female latching members extending from a base portion, the latching members spaced apart as said through holes, whereby when the central core member is placed between the two flanges, the male and female latching members of the hermaphroditic fastener member may be placed in the through holes and become latched with respective female and male latching members of a diametrically opposed and complementary fastener member.

10. The fastener of claim 9 wherein the male latching member comprises a post having annular threads thereon.

11. The fastener of claim 10 wherein the female latching member comprises resilient beam portions extending from the base member having a latch thereon for interlocking with annular threads of a complementary male latching member.

* * * * *